US006379219B1

(12) United States Patent
Oba

(10) Patent No.: US 6,379,219 B1
(45) Date of Patent: Apr. 30, 2002

(54) CHEMICAL MECHANICAL POLISHING MACHINE AND CHEMICAL MECHANICAL POLISHING METHOD

(75) Inventor: Takayuki Oba, Kanagawa (JP)

(73) Assignee: Semiconductor Leading Edge Technologies, Inc., Kanagawa (JP)

( * ) Notice: Subject to any disclaimer, the term of this patent is extended or adjusted under 35 U.S.C. 154(b) by 0 days.

(21) Appl. No.: 09/577,126

(22) Filed: May 24, 2000

(30) Foreign Application Priority Data

Jul. 5, 1999 (JP) ..... 11-191057

(51) Int. Cl.[7] ..... B24B 49/00
(52) U.S. Cl. ..... 451/8; 451/6; 451/286
(58) Field of Search ..... 451/5, 6, 8, 41, 451/286, 287, 288, 289, 290

(56) References Cited

U.S. PATENT DOCUMENTS 5,240,552 A * 8/1993 Yu et al. ..... 156/636
5,399,234 A * 3/1995 Yu et al. ..... 156/636
5,439,551 A * 8/1995 Meikle et al. ..... 156/626.1
5,876,265 A * 3/1999 Kojima ..... 451/10
6,051,500 A * 4/2000 Maury et al. ..... 438/692

FOREIGN PATENT DOCUMENTS

JP 09-150367 6/1997
JP 10-166261 6/1998
JP 10-256212 9/1998

OTHER PUBLICATIONS

"Memory and Logic", The International Technology Roadmap for Semiconductors, 1999; pp. 86–89.

* cited by examiner

*Primary Examiner*—Timothy V. Eley
*Assistant Examiner*—Dung Van Nguyen
(74) *Attorney, Agent, or Firm*—Foley & Lardner

(57) ABSTRACT

At least two elastic wave sensors are disposed in contact with a workpiece such as a microstructure or an optical structure. Elastic waves generated during chemical mechanical polishing of the workpiece are monitored by using the elastic wave sensors. Chemical mechanical polishing conditions are set to achieve uniform chemical mechanical polishing, or an ending point of the chemical mechanical polishing is set based on the monitored signal by the elastic wave sensors, and a process is carried out for chemical mechanical polishing. By the process, a workpiece is polished uniformly to flatten steps in the workpiece or to flatten surface defects of a structure. Alternatively, by the process, a workpiece having a laminated structure is polished up to an interface of the laminated structure.

17 Claims, 7 Drawing Sheets

CHEMICAL MECHANICAL POLISHING MACHINE AND CHEMICAL MECHANICAL POLISHING METHOD

BACKGROUND OF THE INVENTION

1. Field of the Invention

The present invention relates to a precision super-flat surface polishing technique capable of flattening a microstructure, such as a semiconductor device or a micromachine. The present invention may be applied to polish steps in an optical structure formed of optical materials, such as calcium fluoride ($CaF_2$), or a structural surface having defects. The present invention also relates to a super-flat surface polishing technique capable of rapidly and uniformly carrying out the chemical mechanical polishing (CMP) to an optional interface of such a microstructure or a laminated optical structure.

2. Background Art

FIG. 8 shows a conceptual perspective view for explaining a conventional chemical mechanical polishing machine. The chemical mechanical polishing machine carries out a chemical mechanical polishing process (CMP process) for flattening a surface or polishing up to an predetermined interface of a microstructure such as a semiconductor device or a micromachine, or of an optical structure made of an optical material, such as calcium fluoride (CaF2). Referring to FIG. 8, the chemical mechanical polishing machine holds a silicon wafer 85 on a head 83, and brings a surface of a silicon wafer 85 into contact with a pad 82 by a predetermined load 86, supplies a chemical liquid 84 containing abrasive grains at a predetermined flow rate onto a table 81 and rotates the head 83 and the table 81 for the chemical mechanical polishing of the silicon wafer 85.

From the industrial and functional point of view, the miniaturization of microstructures or optical structures has made a rapid progress in recent years and a design rule on the order of a value in the range of micrometers ($\mu$m) to nanometers (nm) has been applied. Such chemical mechanical polishing techniques relevant to semiconductor fields are mentioned in "The National Technology Roadmap for Semiconductors Technology Needs", SIA, 1997 Edition.

FIG. 9 shows a cross sectional view of a semiconductor device for explaining a polishing process of an interlayer insulating film formed on a semiconductor wafer, and FIG. 10 shows a cross sectional view of another semiconductor device for explaining processes for flattening a metal film and forming buried wiring lines on a semiconductor wafer by chemical mechanical polishing. In a semiconductor device, as mentioned above, the wiring lines are densely arranged on the basis of a design rule on the order of a value in the range of micrometers to nanometers.

As shown in FIG. 9, a silicon dioxide film 93 is formed on a silicon wafer 94, and aluminum wiring lines 91 are formed on the silicon dioxide film 93. A silicon dioxide film 92 is formed on the silicon dioxide film 93 so as to cover the aluminum wiring lines 91. Under the situation, there has been a demand for a technique capable of flattening the surface of a silicon dioxide film 92 by removing a portion as indicated by "Polished-off" in FIG. 9 by chemical mechanical polishing.

Similarly, as shown in FIG. 10, a silicon dioxide film 103 is formed on a silicon wafer 104. A TiN/Ti film 101 and a tungsten CVD film 102 are formed by chemical vapor deposition process on the silicon dioxide film 103 to form buried wiring lines embedded in grooves of a silicon dioxide film 103. Under the situation, there has been a demand for super-flattening and high-speed polishing techniques to form buried wiring lines embedded in a silicon dioxide film 103 by subjecting the CVD tungsten film 102 and the TiN/Ti film 101 to chemical mechanical polishing.

Similarly, in micromachine fields, a processing technique is demanded which is capable of achieving processing in a high design rule higher than that demanded by the techniques relating to semiconductor devices. Similarly, in optical material fields, a processing technique is demanded which achieve an accuracy on an atomic level with respect to crystal plane orientation or crystal defects.

In a conventional flattening technique under the technical background as described above, a chemical mechanical polishing time (CMP time) has been calculated on the basis of a state after finishing chemical mechanical polishing, or a chemical mechanical polishing time has been calculated by using a measured film thickness determined by on-site observation. In a conventional technique for embedding a metal film, a chemical mechanical polishing time has been determined by monitoring a change in frictional force or vibration that occurs when the chemical mechanical polishing process changes from polishing a metal film to polishing an insulating film. For instance, as shown in FIG. 8, the changes of the rotational strain of the head 83 or the shaft of the table 81 are measured in a chemical mechanical polishing machine.

The conventional techniques, however, have the following problems. First, the silicon wafer 85 (See FIG. 8) that does not contribute to productivity is consumed, and time is wasted before starting production. When the pad 82 and the chemical liquid 84 are changed, the chemical mechanical polishing rate (CMP rate) changes accordingly. To know a removed amount and to stabilize the CMP rate, chemical mechanical polishing must be repeated, the chemical mechanical polishing condition must be examined, and the results of examination must be fed back to the chemical mechanical polishing process until a desired process condition is set.

Secondly, neither a fine change in polishing condition nor different polishing conditions distributed in the surface of the wafer can be easily corrected, and hence the accuracy of chemical mechanical polishing is reduced. An original signal indicating a rotational strain to which reference is made to know a chemical mechanical polishing condition is transferred through the head 83 and the table 81. Consequently, a signal is produced by averaging or deforming the original signal.

SUMMARY OF THE INVENTION

Accordingly, the present invention has been conceived to solve the foregoing problems and it is therefore an object of the present invention to provide a precision super-flat surface polishing machine and a precision super-flat surface polishing method capable of quickly and uniformly achieving the flattening of steps in a microstructure or an optical structure, or capable of achieving the flattening of the surface having defects of a structure. Further object of the present invention is to provide a precision polishing machine and a polishing method capable of controlling polishing up to a predetermined interface of a laminated structure of microstructures or optical structures.

According to one aspect of the present invention, a chemical mechanical polishing machine comprises at least two elastic wave sensors to be disposed so as to be in contact with a workpiece to be polished. The elastic wave sensors monitor elastic waves generated by chemical mechanical polishing rupture that occurs during a chemical mechanical polishing process for the workpiece. A means is provided for setting chemical mechanical polishing conditions to achieve uniform chemical mechanical polishing on the basis of signals provided by the elastic wave sensors.

According to another aspect of the present invention, a chemical mechanical polishing machine comprises an ultrasonic wave generator to be disposed so as to be in contact with a workpiece and capable of applying phonons to a part of the workpiece where lattice vibrations are generated. At least two elastic wave sensors are provided to be disposed so as to be in contact with the workpiece. The elastic wave sensors monitor phonon echoes generated by the part of the workpiece when the phonons are applied thereto during a chemical mechanical polishing process for polishing the workpiece. A means is provided for setting chemical mechanical polishing conditions for achieving uniform chemical mechanical polishing on the basis of signals provided by the elastic wave sensors.

According to another aspect of the present invention, a chemical mechanical polishing machine comprises an ultrasonic wave generator to be disposed so as to be in contact with a workpiece and capable of applying phonons to a part of the workpiece where lattice vibrations are generated. At least two elastic wave sensors are provided to be disposed so as to be in contact with the workpiece The elastic wave sensors monitor phonon echoes generated by the part of the workpiece when the phonons are applied thereto during a chemical mechanical polishing process for polishing the workpiece. A means is provided for setting chemical mechanical polishing conditions for achieving uniform chemical mechanical polishing on the basis of signals provided by the elastic wave sensors.

According to another aspect of the present invention, a chemical mechanical polishing machine comprises an ultrasonic wave generator to be disposed so as to be in contact with a laminated workpiece. The ultrasonic wave generator applies phonons to a part of the workpiece where lattice vibrations are generated during a chemical mechanical polishing process for the workpiece. At least two elastic wave sensors are provided to be disposed so as to be in contact with the workpiece. The elastic wave sensors monitor phonon echoes generated by the part of the workpiece. A means is provided for determining an end point of the chemical mechanical polishing process at an optional interface in the laminated workpiece on the basis of signals provided by the elastic wave sensors.

Other features and advantages of the invention will be apparent from the following description taken in connection with the accompanying drawing.

BRIEF DESCRIPTION OF THE DRAWINGS

The above and other objects, features and advantages of the present invention will become apparent from the following description taken in connection with the accompanying drawings, in which.

DETAILED DESCRIPTION OF THE PREFERRED EMBODIMENTS

Figure 1:
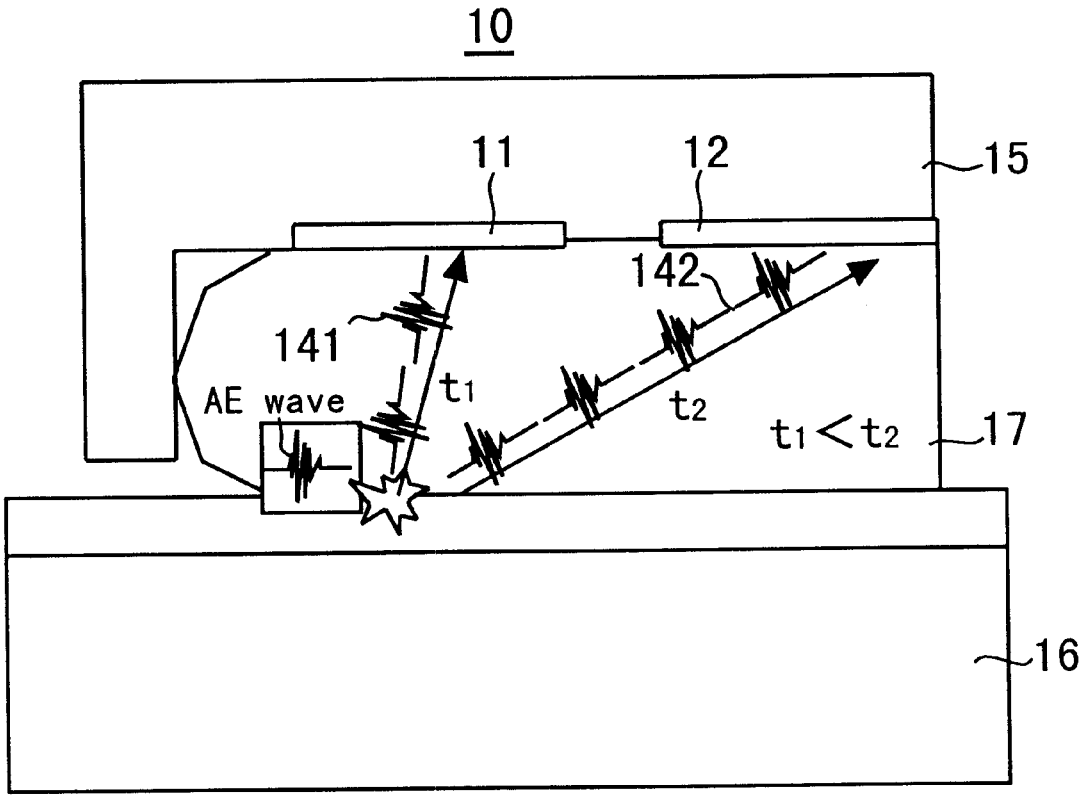
FIG. 1 is a view of assistance in explaining the principle of a precision super-flat surface polishing machine and method according to the present invention using AE wave sensing.

The features of the embodiments are as follows. In the preferred embodiments, at least two elastic wave sensors are disposed in contact with a workpiece such as a microstructure or an optical structure. The elastic wave sensors may be positioned at one side of the workpiece, or each of the elastic wave sensors may be placed upside and downside of the workpiece respectively to contact the workpiece. Elastic waves generated during chemical mechanical polishing of the workpiece are monitored by using the elastic wave sensors. Chemical mechanical polishing conditions are set to achieve uniform chemical mechanical polishing, or an ending point of the chemical mechanical polishing is set based on the monitored signal by the elastic wave sensors, and a process is carried out for chemical mechanical polishing. By the process, a workpiece is polished uniformly to flatten steps in the workpiece or to flatten surface defects of a structure. Alternatively, by the process, a workpiece having a laminated structure is polished up to an interface of the laminated structure.

Preferred embodiments of the present invention will be described hereinafter with reference to the accompanying drawings, in which like parts are denoted by the same reference characters.

First Embodiment

A first embodiment of the present invention will be described with reference to the accompanying drawing. FIG. 1 shows a conceptual structure for explaining the principle of a precision super-flat surface polishing machine and method which adopt sensing of AE wave (acoustic emission wave).

Referring to FIG. 1 showing the precision super-flat surface polishing machine 10, there are shown a first probe (elastic wave sensor) 11, a second probe (elastic wave sensor) 12, AE waves (acoustic emission waves) 141 and 142, a head 15, a table 16, a wafer (workpiece) 17 and delays $t_1$ and $t_2$.

Figure 8:
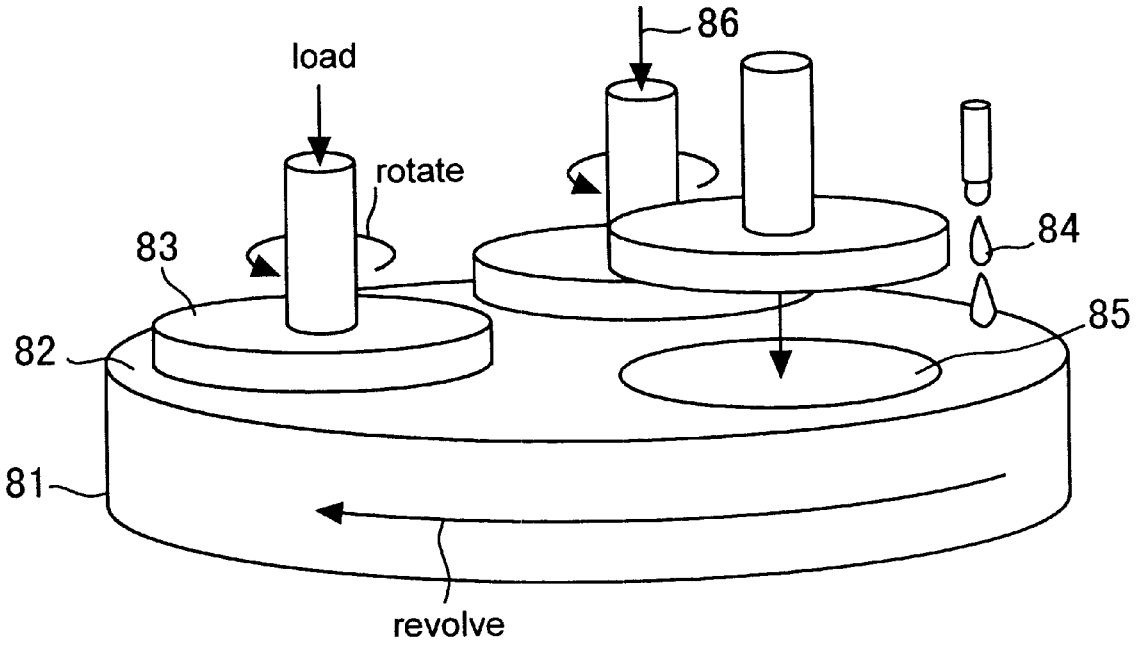
Fig. 8 Background Art
FIG. 8 is a perspective view of assistance in explaining the operation of a generally known chemical mechanical polishing machine.
Figure 9:
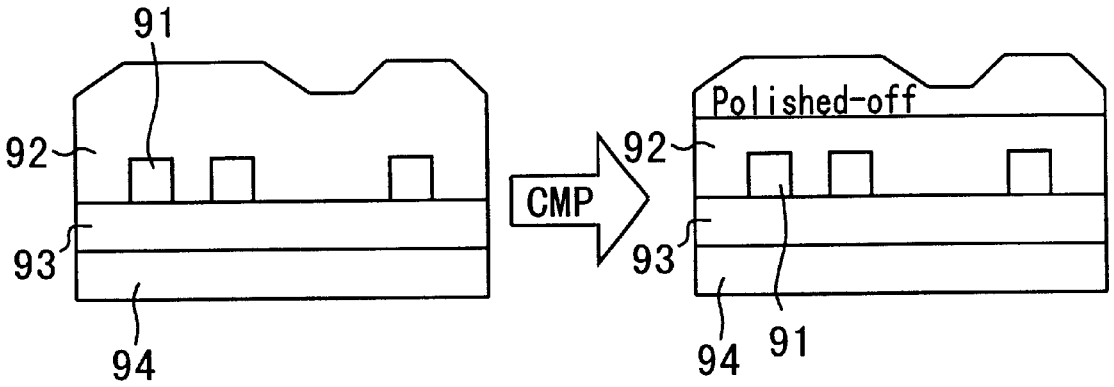
Fig. 9 Background Art
FIG. 9 is a typical sectional view of a semiconductor device in a polishing process for flattening an interlayer insulating film formed on a semiconductor wafer.

As shown in FIG. 1, the precision super-flat surface polishing machine 10 is similar in basic construction to the chemical mechanical polishing machine shown in FIG. 8, and is characterized by a plurality of probes 11, 12 mounted on the head 15 to be in contact with the wafer 17. In other words, the first probe 11 and the second probe 12 are placed so as to be in contact with the wafer 17 when polishing the wafer 17.

Referring to FIG. 1, AE waves 141 and 142 generated by a part of the wafer 17 under chemical mechanical polishing are sensed by the first probe 11 and the second probe 12, respectively. Since the magnitude and mode of a phenomenon, i.e., rupture caused by chemical mechanical polishing (CMP rupture), are represented by the characteristic spectra of the AE waves 141 and 142 sensed by the first probe 11 and the second probe 12, the characteristic spectra of the AE waves 141 and 142 are analyzed to identify the phenomenon.

Since the AE waves 141 and 142 propagate at a fixed propagation velocity through a uniform solid (the wafer 17 in this embodiment), the part of the wafer 17 where the phenomenon occurred is identified on the basis of measured delays $t_1$ and $t_2$, i.e., times between the occurrence of the phenomenon and the arrival of the AE waves 141 and 142 respectively at the first probe 11 and the second probe 12.

Second Embodiment

Figure 2:
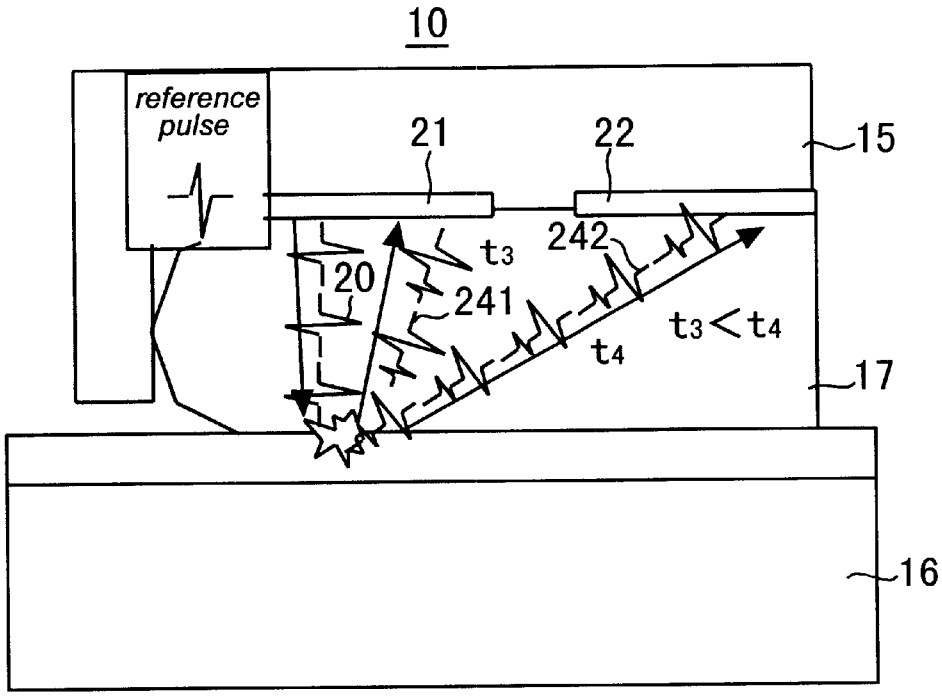
FIG. 2 is a view of assistance in explaining the principle of a precision super-flat surface polishing machine and method according to the present invention using phonon echo.

A second embodiment of the present invention will be described with reference to the accompanying drawing. FIG. 2 shows conceptual structure for explaining the principle of a precision super-flat surface polishing machine and method which adopts phonon echoes according to the present embodiment.

Referring to FIG. 2 showing a precision super-flat surface polishing machine 10, there are shown a head 15, a table 16, a wafer (workpiece) 17, a reference pulse signal (ultrasonic wave) 20, a third probe 21 (elastic wave sensor and ultrasonic wave generator), a fourth probe (elastic wave sensor) 22, phonon echoes (elastic waves) 241 and 242 and delays $t_3$ and $t_4$.

As shown in FIG. 2, the precision super-flat surface polishing machine and method in the second embodiment uses a physical phenomenon such as generation of lattice vibrations (phonons) by a solid (elastic body) subjected to a chemical mechanical polishing on the level of atoms or atomic groups. In this method, a ultrasonic wave is applied to a part of the solid where the lattice vibrations are generated, and phonon echoes from the part of the solid generating the lattice vibrations is sensed, and chemical mechanical polishing condition, i.e., the state of the substance, is estimated on the basis of the sensed phonon echoes.

The chemical mechanical polishing machine 10 in this embodiment is similar in basic construction as the chemical mechanical polishing machine shown in FIG. 8, and is characterized by a plurality of probes 21, 22 mounted on the head 15 to be in contact with the wafer 17. In other words, the third probe 21 and the fourth probe 22 are placed so as to be in contact with the wafer 17 when polishing the wafer 17. The third probe 21 serves as an ultrasonic wave generating device and an elastic wave sensor, and the fourth probe 22 serves as an elastic wave sensor.

An ultrasonic wave generator included in the third probe 21 applies a reference pulse signal 20 (ultrasonic pulse signal) to a part of the wafer 17 where lattice vibrations are generated during a chemical mechanical polishing process for polishing in a polishing mode on the level of atoms or atomic groups. Phonon echoes 241 and 242 (elastic waves) are generated by the part of the wafer 17 being polished, and are sensed by the third probe 21 and the fourth probe 22. Chemical mechanical polishing condition, i.e., the state of the substance, is estimated on the basis of the sensed phonon echoes 241 and 242.

The operation of the second embodiment will be described hereinafter. Referring to FIG. 2, the phonon echoes 241 and 242 (elastic waves) generated by the part under chemical mechanical polishing of the wafer 17 are sensed by the third probe 21 and the fourth probe 22. Since the magnitude and mode of a phenomenon, i.e., rupture caused by CMP rupture, are represented by the characteristic spectra of the phonon echoes 241 and 242 sensed by the third probe 21 and the fourth probe 22, the characteristic spectra of the phonon echoes 241 and 242 are analyzed to identify the phenomenon.

Since the phonon echoes 241 and 242 propagate at a fixed propagation velocity through a uniform solid (elastic body), the part of the wafer 17 where the phenomenon occurred is identified on the basis of measured delays $t_3$ and $t_4$, i.e., times between the occurrence of the phenomenon and the arrival of the phonon echoes 241 and 242 respectively at the third probe 21 and the fourth probe 22.

Third Embodiment

A precision super-flat surface polishing machine and method in a third embodiment according to the present invention uses the precision super-flat surface polishing machine or method described in the first or the second embodiment. The third embodiment will be described with reference to the accompanying drawing.

Figure 3:
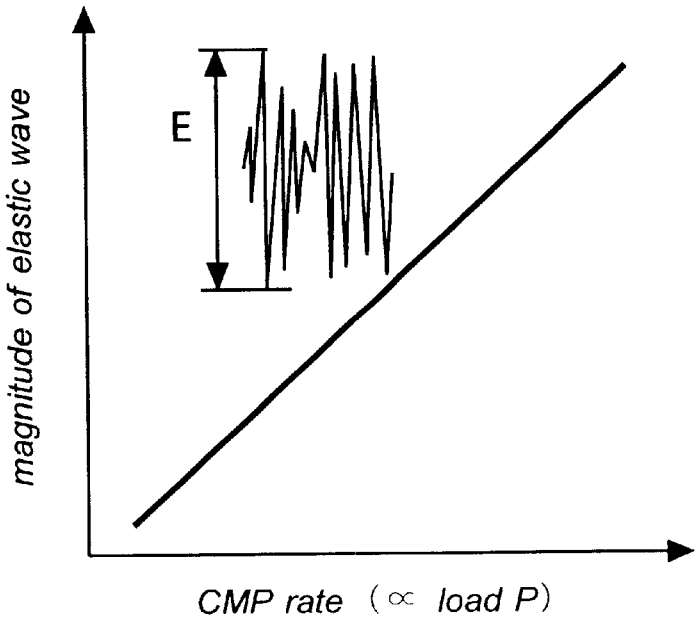
FIG. 3 is a graph showing the relation between the wave magnitude of an elastic wave generated during polishing and CMP rate.

FIG. 3 is a graph showing the relation between the elastic wave magnitude E of a wave generated during polishing and a CMP rate, which is proportional to a load P. In FIG. 3, CMP rate is measured on the horizontal axis and elastic wave magnitude E is measured on the vertical axis.

In carrying out the precision super-flat surface polishing method by using the precision polishing machine 10 shown in FIG. 1 and described in the first embodiment, the wafer 17 is mounted on the head 15 of the chemical mechanical polishing machine 10, and the first probe 11 and the second probe 12 are placed on the head 15 as mentioned in the first embodiment.

Generally, the wave magnitude E of the AE waves 141 and 142 generated by polishing rupture is proportional to CMP rate, and CMP rate is dependent on load P. The relation between wave magnitude E and CMP rate can be expressed by Expression (1).

$$E=f(\text{CMP rate}) \tag{1}$$

In Expression (1), "f" represents a function. CMP rate is proportional to load P.

Since the AE waves 141 and 142 propagate through the wafer 17 at a fixed propagation velocity as mentioned in the first embodiment$_1$ the part of the wafer 17 where the phenomenon occurred can be identified on the basis of the measured delays $t_1$ and $t_2$, i.e., times between the occurrence of the phenomenon and the arrival of the AE waves 141 and 142 respectively at the first probe 11 and the second probe 12.

In carrying out a chemical mechanical polishing method by using the chemical mechanical polishing machine shown in FIG. 2 and described in the second embodiment, the wafer 17 is mounted on the head 15 of the chemical mechanical polishing machine 10, the third probe 21 and the fourth probe 22 are placed on the head 15 as described in the description of the second embodiment.

The wave magnitude E of the phonon echoes 241 and 242 generated by polishing rupture is generally proportional to CMP rate, and CMP rate is dependent on load P. The relation between wave magnitude E and CMP rate can be expressed by Expression (1).

Since the phonon echoes 241 and 242 propagate through the wafer 17 at a fixed propagation velocity as mentioned in the second embodiment, the part of the wafer 17 where the phenomenon occurred can be identified on the basis of the measured delays $t_3$ and $t_4$, i.e., times between the occurrence of the phenomenon and the arrival of the phonon echoes 241 and 242 respectively at the third probe 21 and the fourth probe 22.

Figure 4:
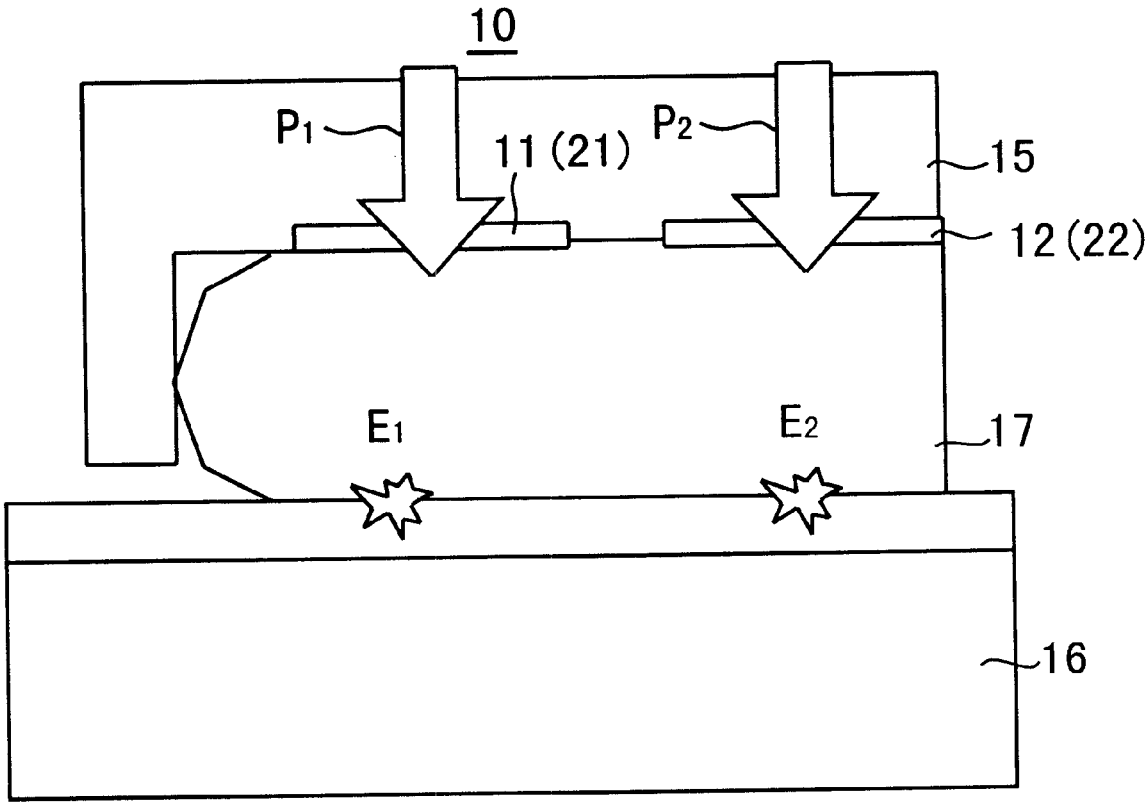
FIG. 4 is a view of assistance in explaining the principle of precision super-flat surface polishing machine and method according to the present invention capable of polishing with intrasurface uniformity.

FIG. 4 is a view of assistance in explaining the principle of a precision super-flat surface polishing machine and method according to the third embodiment of the present invention. Referring to FIG. 4, there are shown the precision super-flat surface polishing machine 10, a first probe 11 serving as an elastic wave sensor, a second probe 12 serving as another elastic wave sensor, a head 15, a table 16, a wafer (workpiece) 17, a third probe 21 serving as an elastic wave sensor and an ultrasonic wave generator, and a fourth probe 22 serving as an elastic wave sensor. Reference character $E_1$ and $E_2$ show each location where a AE wave or phonon echo is generated, and also shows its wave magnitude respectively. Reference characters $P_1$ and $P_2$ show each load exerted on the location E1 and E2 respectively.

Suppose that a first AE wave of a magnitude $E_1$ and a second AE wave of a magnitude $E_2$ are generated at two locations in the wafer 17 as shown in FIG. 4, and the loads $P_1$ and $P_2$ are applied to the wafer 17 on that two locations respectively. When a load difference $P_1-P_2$ is identified as $\Delta P$, then, $\Delta P=P_1-P_2$.

Since uniform polishing causes uniform rupture, the wave magnitudes $E_1$ and $E_2$ coincide with each other. When a difference $E_1-E_2$ of the wave magnitudes is identified as $\Delta E$, then, $\Delta E=E_1-E_2=0$. Consequently, the loads $P_1$ and $P_2$ and the load difference $\Delta P$ can be fixed or maintained.

Since uniform polishing causes uniform rupture, the wave magnitudes $E_1$ and $E_2$ coincide with each other; that is, $\Delta E=E_1-E_2=0$. Consequently, the loads $P_1$ and P2 and the load difference $\Delta P$ can be fixed or maintained.

If $\Delta E<0$, a chemical mechanical polishing effect represented by the wave magnitude $E_1$ is lower than that represented by the wave magnitude $E_2$. Consequently, uniform chemical mechanical polishing can be achieved by the feedback control of the load $P_1$ or $P_2$ to increase the load difference $\Delta P$ ($=P_1-P_2$) so that the magnitude difference comes to zero, i.e. $\Delta E=0$.

If $\Delta E>0$, a chemical mechanical polishing effect represented by the wave magnitude $E_1$ is higher than that represented by the wave magnitude $E_2$. Consequently, uniform chemical mechanical polishing can be achieved by the feedback control of the load $P_1$ or $P_2$ to decrease the load difference $\Delta P$ ($=P_1-P_2$) so that the magnitude difference comes to zero, i.e. $\Delta E=0$.

Next, suppose that the first phonon echo of the wave magnitude $E_1$ and the second phonon echo of the magnitude $E_2$ are generated at positions indicated at $E_1$ and $E_2$ shown in FIG. 4, respectively, and the loads $P_1$ and $P_2$ are applied to parts of the head 15 corresponding to the parts $E_1$ and $E_2$, and $\Delta P=P_1-P_2$.

Since uniform polishing causes uniform rupture, the wave magnitudes $E_1$ and $E_2$ coincide with each other; that is, $\Delta E=E_1-E_2=0$. Consequently, the loads $P_1$ and $P_2$ and the load difference $\Delta P$ can be fixed or maintained.

If $\Delta E<0$, a chemical mechanical polishing effect represented by the wave magnitude $E_1$ is lower than that represented by the wave magnitude $E_2$. Consequently, uniform chemical mechanical polishing can be achieved by the feedback control of the load $P_1$ or $P_2$ to increase the load difference $\Delta P$ so that the magnitude difference $\Delta E=0$.

If $\Delta E>0$, a chemical mechanical polishing effect represented by the wave magnitude $E_1$ is higher than that represented by the wave magnitude $E_2$. Consequently, uniform chemical mechanical polishing can be achieved by the feedback control of the load $P_1$ or $P_2$ to decrease the load difference $\Delta P$ so that the magnitude difference $\Delta E=0$.

Fourth Embodiment

A fourth embodiment of the present invention relates to a technique for uniformly polishing a workpiece a predetermined amount up to a predetermined interface of the workpiece by using a precision super-flat surface polishing machine and method as described in the first or the second embodiment. The fourth embodiment will be described hereinafter with reference to the accompanying drawing.

Figure 5:
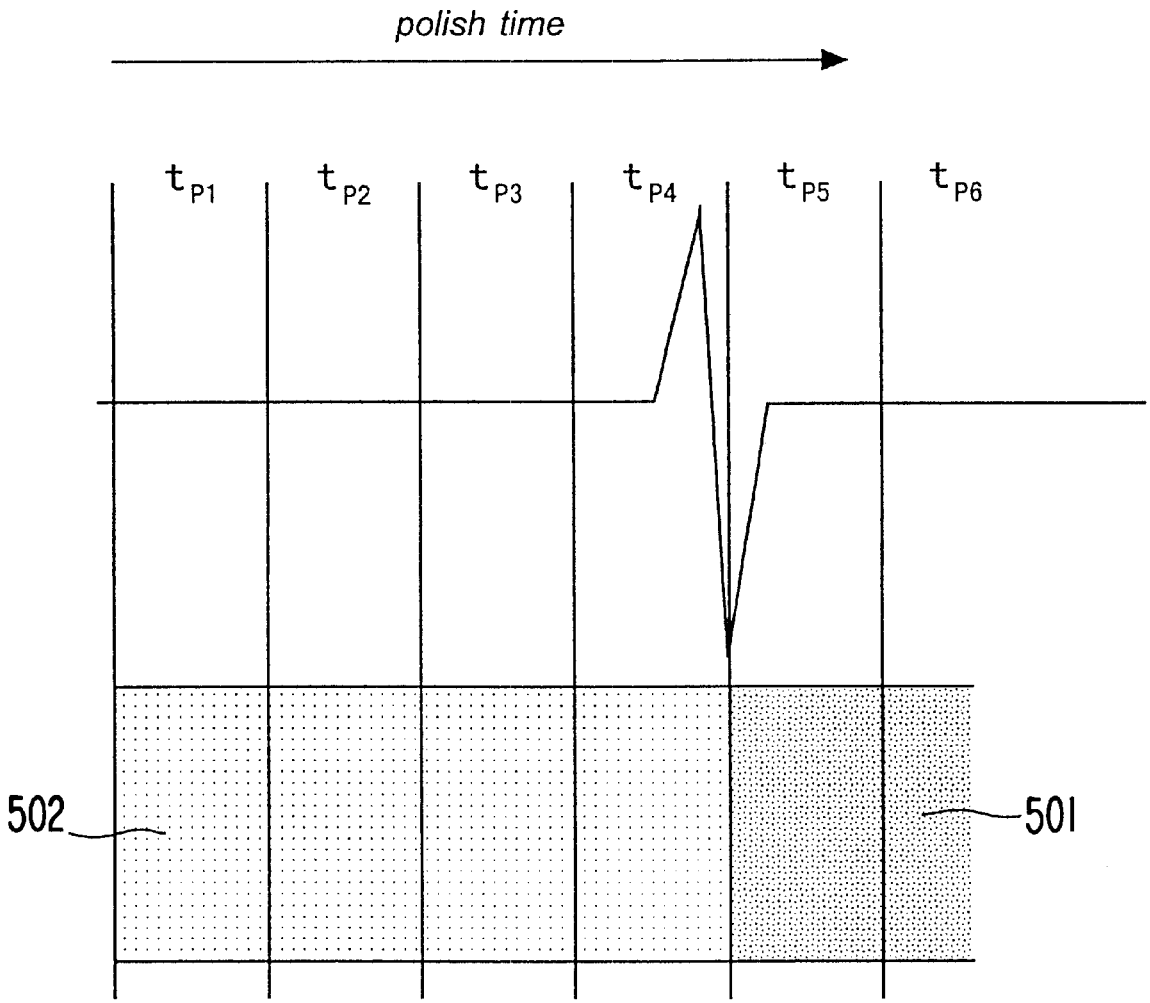
FIG. 5 is a diagram typically showing an elastic wave change that occurs in the interface between different kinds of metal films when polishing a laminated structure.

FIG. 5 is a diagram typically showing an elastic wave change that occurs in the interface between films of different metals when polishing a laminated structure. In FIG. 5, the horizontal axis shows the thickness of a laminated structure or polishing time. Reference numeral 501 designates a titanium nitride film formed by a CVD process in a lower side of the laminated structure, 502 designates a tungsten CVD film formed by a CVD process in an upper side of the laminated structure, and $t_{P1}$, $t_{P2}$, $t_{P3}$, $t_{P4}$, $t_{P5}$, and $t_{P6}$ show polishing times.

Figure 6:
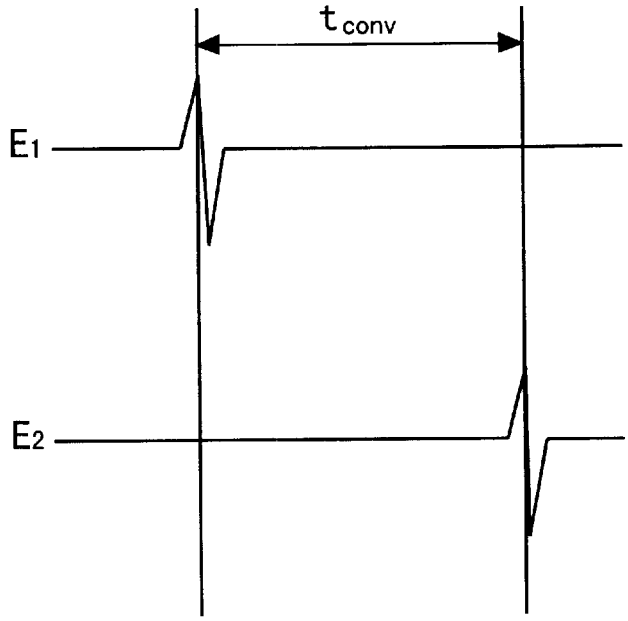
FIG. 6 is a diagram typically showing elastic waves indicating an event change that occurs during the chemical mechanical polishing of the interface having intrasurface distribution between different kinds of metal films.

FIG. 6 is a diagram typically showing elastic waves indicating an event change that occurs during the chemical mechanical polishing of the interface having intrasurface distribution between the different kinds of metal films. In FIG. 6, reference characters $E_1$ and $E_2$ indicate the wave magnitudes of elastic waves generated in different parts of the workpiece, and $t_{conv}$ indicates a delay time.

Figure 10:
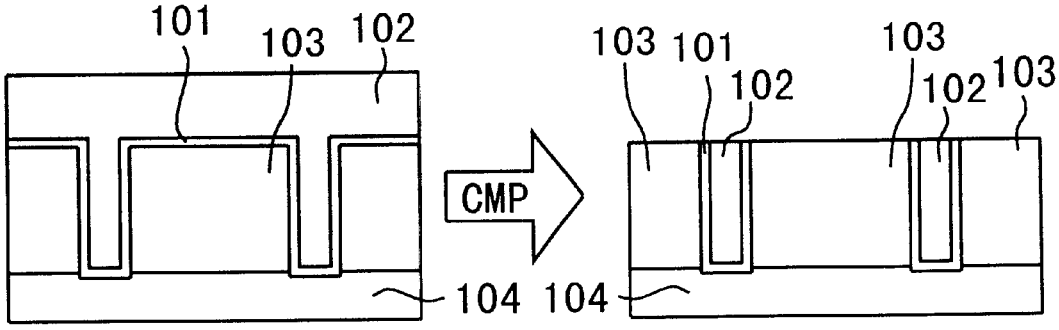
Fig. 10 Background Art
FIG. 10 is a typical sectional view of a semiconductor device in a process of forming embedded wiring lines by polishing and flattening a metal film by chemical mechanical polishing.

Next, there is described a uniform polishing technique to polish up to a predetermined interface of a workpiece, which uses a precision super-flat surface polishing machine and method as described with reference to FIG. 1 in the first embodiment. The present embodiment will be described on an assumption, for example, that the workpiece 17 (see FIG. 1) is, as shown in FIG. 10, a silicon substrate 104 provided with a patterned silicon dioxide film ($SiO_2$ film) 103, and a metal film 101 and 102 deposited so as to cover the patterned silicon dioxide film 103. In the same context, it is supposed that the laminated structure includes, as shown in FIG. 5, the titanium nitride CVD film 101 and the tungsten CVD film 102, which was used widely in industries.

As shown in FIG. 1, the workpiece 17 is mounted on the head 15 of the precision super-flat surface polishing machine 10. The first probe 11 and the second probe 12 are placed in the arrangement as shown in FIG. 1.

The characteristic of an AE wave generated by the chemical mechanical polishing of a workpiece 17 is dependent on the quality of a material, i.e., a kind of metal in this embodiment, forming the workpiece. Discrimination between different materials can be achieved by finding natural frequency or wave magnitude difference between the elastic waves.

When the tungsten CVD film 102 has been polished off and the chemical mechanical polishing of the titanium nitride film 101 is started as time passes from the time $t_{P1}$ to the time $t_{P6}$, a variation point appears in the AE wave at the time $t_{P5}$ corresponding to the interface between the tungsten CVD film 102 and the titanium nitride film 101 as shown in FIG. 5. Thus, the position with respect to thickness of a part of the laminated structure under chemical mechanical polishing can be known from the variation point.

If the tungsten CVD film 102 has an irregular thickness and the CMP rate, at which the tungsten CVD film 102 is polished, varies, a variation point in the AE wave of the magnitude $E_2$ generated in a part of the workpiece 17 appears with a delay $t_{conv}$ behind the appearance of a variation point in the AE wave of the magnitude $E_1$ generated in another part of the workpiece 17 as shown in FIG. 6 when the chemical mechanical polishing of the titanium nitride film 101 is started. Such a delay is called chemical mechanical polishing distribution. If chemical mechanical polishing is continued in this state, the underlying oxide film is polished excessively or scratches are formed in the underlying oxide film.

Figure 7:
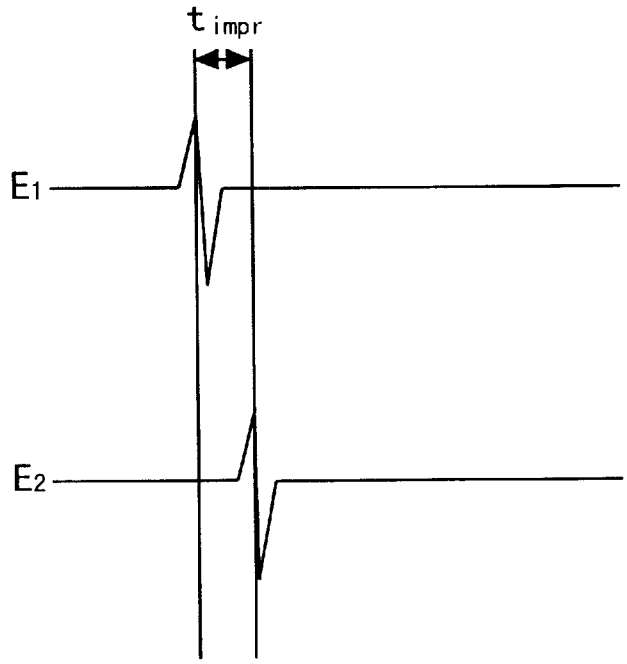
FIG. 7 is a diagram showing an elastic wave produced when a precision super-flat surface polishing machine and method according to the present invention are used.

FIG. 7 shows the waveforms of elastic waves, i.e. AE waves, generated when the precision super-flat surface polishing method is carried out according to the present embodiment. In FIG. 7, indicated at $E_1$ and $E_2$ are the respective magnitudes of elastic waves generated in different parts, and $t_{impr}$ is a delay time. When the CMP rate at a first part is reduced by adjusting a load $P_1$ applied to the first part upon the occurrence of the first event in the first AE wave, and the CMP rate at a second part is increased by adjusting a load $P_2$ applied to the second part upon the occurrence of the second event in the second AE wave, the delay $t_{impr}$ is reduced ($t_{impr}<t_{conv}$).

The difference between the events shown in the AE waves due to the completion of polishing a metal film, such as the titanium nitride film 501, and the start of polishing an insulating film, such as the silicon dioxide film, is similarly caused as in the case of difference in metal film quality. Therefore, the present embodiment may be used to find the end point of chemical mechanical polishing.

Next, there is described an uniform polishing technique to polish up to a predetermined interface of a workpiece, which uses a precision super-flat surface polishing machine and method as described with reference to FIG. 2 in the second embodiment. The present embodiment will be described on an assumption, for example, that the workpiece 17 (see FIG. 2) is, as shown in FIG. 10, a silicon substrate 104 provided with a patterned silicon dioxide film ($SiO_2$ film) 103, and a metal film 101 and 102 deposited so as to cover the patterned silicon dioxide film 103. In the same context, it is supposed that the laminated structure includes, as shown in FIG. 5, the titanium nitride CVD film 101 and the tungsten CVD film 102, which are used widely in industries.

As shown in FIG. 2, the workpiece 17 is mounted on the head 15 of the precision super-flat surface polishing machine 10. The third probe 21 (elastic wave sensor and ultrasonic wave generator) and the fourth probe 22 (elastic wave sensor) are placed in the arrangement as shown in FIG. 2.

Characteristic of a phonon echo (elastic wave) generated by the chemical mechanical polishing of a workpiece 17 is dependent on the quality of a material, i.e., a kind of metal in this embodiment, forming the workpiece. Discrimination between different materials can be achieved by finding natural frequency or wave magnitude differences between the phonon echoes.

When the tungsten CVD film 102 has been polished off and the chemical mechanical polishing of the titanium nitride film 101 is started as time passes from the time $t_{P1}$ to the time $t_{P6}$, a variation point appears in the phonon echo at the time $t_{P5}$ corresponding to the interface between the tungsten CVD film 102 and the titanium nitride film 101 as shown in FIG. 5. Thus, the position with respect to thickness of a part of the laminated structure under chemical mechanical polishing can be known from the variation point.

If the tungsten CVD film 102 has an irregular thickness and if the CMP rate, at which the tungsten CVD film 102 is polished, varies, a variation point in the phonon echo of the magnitude $E_2$ generated in a part of the workpiece 17 appears with a delay $t_{conv}$ behind the appearance of a variation point in the phonon echo of the magnitude $E_1$ generated in another part of the workpiece 17 as shown in FIG. 6 when the chemical mechanical polishing of the titanium nitride film 101 is started. Such a delay is called chemical mechanical polishing distribution. If chemical mechanical polishing is continued in this state, the underlying oxide film is polished excessively or scratches are formed in the underlying oxide film.

FIG. 7 shows the waveforms of elastic waves, i.e. phonon echoes, generated when the precision super-flat surface polishing method is carried out according to the present embodiment. In FIG. 7, indicated at $E_1$ and $E_2$ are the respective magnitudes of elastic waves generated in different parts, and $t_{impr}$ is a delay time. When the CMP rate at a first part is reduced by adjusting a load $P_1$ applied to the first part upon the occurrence of the first event in the first AE wave, and the CMP rate at a second part is increased by adjusting a load $P_2$ applied to the second part upon the occurrence of the second event in the second AE wave, the delay $t_{impr}$ is reduced ($t_{impr}<t_{conv}$).

The difference between the events shown in the phonon echoes due to the completion of polishing a metal film, such as the titanium nitride film 501, and the start of polishing an insulating film, such as the silicon dioxide film, is similarly caused as in the case of difference in metal film quality. Therefore, the present embodiment may be used to find the end point of chemical mechanical polishing.

As apparent from the foregoing description, the foregoing embodiments of the present invention are capable of flattening a microstructure, such as a semiconductor device or a micromachine, capable of flattening steps in an optical structure formed of optical materials, such as calcium fluoride ($CaF_2$), or capable of flattening a structural surface having defects. Further, the foregoing embodiments of the present invention are capable of rapidly and highly uniformly carrying out the chemical mechanical polishing of such a microstructure or a laminated optical structure to a predetermined interface or to an optional interface through the sensing of elastic waves (AE waves or phonon echoes).

The present invention is not limited in its practical application to the foregoing embodiments specifically described herein and many changes and variations may be made therein without departing from the scope thereof. The numbers, positions and shapes of the components of the foregoing embodiments are illustrative and not restrictive.

The entire disclosure of a Japanese Patent Application No. 11-191057, filed on Jul. 5, 1999 including specification, claims, drawings and summary, on which the Convention priority of the present application is based, are incorporated herein by reference in its entirety.

What is claimed is:

1. A chemical mechanical polishing machine comprising:

at least two elastic wave sensors disposed so as to be in contact with a laminated workpiece, the elastic wave sensors monitoring elastic waves generated by chemical mechanical polishing rupture during a chemical mechanical polishing process for the workpiece;

means for determining an end point of the chemical mechanical polishing process at an optional interface in the laminated workpiece by comparing a parameter in signals provided by different ones of said elastic wave sensor, wherein, the parameter is the delay times of the elastic waves measured by said different elastic waves.

2. A chemical mechanical polishing machine comprising:

at least two elastic wave sensors, included in a first and second probes respectively, to be disposed so as to be in contact with different portions of a workpiece to be polished, the elastic wave sensors monitoring elastic waves generated by chemical mechanical polishing rupture that occurs during a chemical mechanical polishing process for the workpiece; and means for setting chemical mechanical polishing conditions for achieving uniform chemical mechanical polishing by comparing a parameter in signals provided by different ones of said elastic wave sensors, wherein, the parameter is the delay times of the elastic waves measured by said first and second probe to identify the location of a chemical mechanical polishing rupture.

3. The chemical mechanical polishing machine according to claim 2, wherein characteristic spectra of the elastic waves sensed by said first and said second probe are analyzed to identify magnitude and/or mode of a chemical mechanical polishing rupture.

4. A chemical mechanical polishing machine comprising:

at least two elastic wave sensors to be disposed so as to be in contact with different portions of a workpiece to be polished, the elastic wave sensors monitoring elastic waves generated by chemical mechanical polishing rupture that occurs during a chemical mechanical polishing process for the workpiece; and means for setting chemical mechanical polishing conditions for achieving uniform chemical mechanical polishing by comparing a parameter in signals provided by different ones of said elastic wave sensors, and further comprising:

an ultrasonic wave generator to be disposed so as to be in contact with the workpiece and capable of applying phonons to a part of the workpiece where lattice vibrations are generated; and wherein the at least two elastic sensors monitor phonon echoes generated by the different parts of the workpiece when the phonons are applied to the workpiece during a chemical mechanical polishing process.

5. The chemical mechanical polishing machine according to claim 4, further comprising:

a probe including said ultrasonic wave generator and one of said elastic wave sensors; and a probe including another one of said elastic wave sensor.

6. The chemical mechanical polishing machine according to claim 5, wherein characteristic spectra of the phonon echoes sensed by said probes are analyzed to identify magnitude and/or mode of a chemical mechanical polishing rupture.

7. The chemical mechanical polishing machine according to claim 5, wherein, delay times of the elastic waves are measured by said probes to identify the location of the chemical mechanical polishing rupture.

8. A chemical mechanical polishing machine comprising:

at least two elastic wave sensors disposed so as to be in contact with a laminated workpiece, the elastic wave sensors monitoring elastic waves generated by chemical mechanical polishing rupture during a chemical mechanical polishing process for the workpiece;

means for determining an end point of the chemical mechanical polishing process at an optional interface in the laminated workpiece by comparing a parameter in signals provided by different ones of said elastic wave sensors, and further comprising:

an ultrasonic wave generator to be disposed so as to be in contact with the laminated workpiece, said ultrasonic wave generator applying phonons to a part of the workpiece where lattice vibrations are generated during the chemical mechanical polishing process for the workpiece;

wherein the at least two elastic sensors monitor phonon echoes generated by the different parts of the workpiece when the phonons are applied to the workpiece.

9. A chemical mechanical polishing method comprising the steps of:

monitoring elastic waves generated by chemical mechanical polishing rupture during a chemical mechanical polishing process for polishing a workpiece by at least two elastic wave sensors disposed so as to be in contact with different parts of the workpiece; and setting chemical mechanical polishing conditions for achieving uniform chemical mechanical polishing by comparing delay times of the elastic waves measured in signals provided by different ones of said elastic wave sensors; and carrying out a chemical mechanical polishing process for flattening a surface of the workpiece.

10. A chemical mechanical polishing method comprising the steps of:

monitoring elastic waves generated by chemical mechanical polishing rupture during a chemical mechanical polishing process for polishing a workpiece by at least two elastic wave sensors disposed so as to be in contact with different parts of the workpiece;

controlling chemical mechanical polishing conditions to equalize characteristics of the elastic wave from a first part and a second part being polished in order to achieve uniform polishing using the parameter of delay times of the elastic waves measured by said different elastic wave sensors.

11. A chemical mechanical polishing method comprising the steps of:

applying phonons generated by an ultrasonic wave generator disposed in contact with a workpiece during a chemical mechanical polishing process to parts of the workpiece where lattice vibrations are generated;

monitoring phonon echoes by at least two elastic wave sensors that each monitors a different part of the workpiece; and setting chemical mechanical polishing conditions by comparing a parameter in signals provided by different ones of said elastic wave sensors so that the workpiece is uniformly polished by the chemical mechanical polishing process; and carrying out the chemical mechanical polishing process for flattening a surface of the workpiece.

12. A chemical mechanical polishing method comprising the steps of:

applying phonons generated by an ultrasonic wave generator disposed in contact with a workpiece during a chemical mechanical polishing process to parts of the workpiece where lattice vibrations are generated, monitoring phonon echoes generated by different parts of the workpiece where lattice vibrations are generated by at least two elastic wave sensors; and controlling chemical mechanical polishing conditions to equalize characteristic of the elastic wave from a first part and a second part being polished in order to achieve uniform polishing.

13. A method for polishing a workpiece comprising the steps of:

sensing elastic wave signals from different portions of the workpiece generated by chemical mechanical polishing rupture that occurs during a chemical mechanical polishing process for the workpiece; and setting a chemical mechanical polishing condition by analyzing delay times of the elastic wave signals from the different portions of the workpiece and generating a control signal based on this analysis for controlling the polishing.

14. A method as defined in claim 13, wherein said setting a condition step comprises analyzing the characteristic spectra of the signals from the different elastic wave sensors.

15. A method for polishing a workpiece comprising the steps of:

sensing elastic wave signals from different portions of the workpiece generated by chemical mechanical polishing rupture that occurs during a chemical mechanical polishing process for the workpiece; and setting a chemical mechanical polishing condition by analyzing characteristic spectra of the signals from the different portions of the workpiece and generating a control signal based on this analysis for controlling the polishing, wherein said setting a condition step further comprises adjusting a load applied to a first part of the workpiece upon the occurrence of a first event in one of the signals; and adjusting a load applied to a second part of the workpiece upon the occurrence of a second event in a different one of said signals.

16. A method for polishing a workpiece comprising the steps of:

sensing elastic wave signals from different portions of the workpiece generated by chemical mechanical polishing rupture that occurs during a chemical mechanical polishing process for the workpiece; and setting a chemical mechanical polishing condition by analyzing a parameter in the signals and generating a control signal based on this analysis for controlling the polishing, wherein said setting a condition step further comprises the steps of comparing the magnitudes of the signals from the different elastic wave sensors, and changing a load difference by changing one or more of a load applied to a first part of the workpiece and a load applied to a second part of the workpiece in order to change a relative magnitude difference between the signals.

17. A method as defined in claim 16, wherein the loads are changed in accordance with a feedback loop so that the magnitude difference is changed to a predetermined number.

* * * * *

UNITED STATES PATENT AND TRADEMARK OFFICE

CERTIFICATE OF CORRECTION

PATENT NO. : 6,379,219 B1
DATED : April 30, 2002
INVENTOR(S) : Takayuki Oba

It is certified that error appears in the above-identified patent and that said Letters Patent is hereby corrected as shown below:

Title page,
Item [30], should read:

-- [30] Foreign Application Priority Data

Jul. 5, 1999 (JP) ..... 11-191057
Apr. 6, 2000 (JP) ..... 2000-105494 --

Signed and Sealed this

Twenty-seventh Day of January, 2004

JON W. DUDAS
*Acting Director of the United States Patent and Trademark Office*